US006129522A

United States Patent [19]

Seo

[11] Patent Number: 6,129,522

[45] Date of Patent: Oct. 10, 2000

[54] SUCTION MUFFLER FOR A COMPRESSOR

[75] Inventor: Seung-don Seo, Suwon, Rep. of Korea

[73] Assignee: Samsung Kwang-Ju Electronics Co., Kwangju, Rep. of Korea

[21] Appl. No.: 09/179,458

[22] Filed: Oct. 27, 1998

[30] Foreign Application Priority Data

Nov. 5, 1997 [KR] Rep. of Korea ..... P97-58171

[51] Int. Cl.[7] ..... F04B 49/10

[52] U.S. Cl. ..... 417/312

[58] Field of Search ..... 417/312, 363; 181/463, 255, 269, 271, 275

[56] References Cited

U.S. PATENT DOCUMENTS 5,938,411 8/1999 Seo ..... 417/312

*Primary Examiner*—Teresa Walberg
*Assistant Examiner*—Vinod D Patel
*Attorney, Agent, or Firm*—Burns, Doane, Swecker & Mathis, L.L.P.

[57] ABSTRACT

Disclosed is a suction muffler for a compressor. The suction muffler has a body and a suction pipe. The body has an expansion chamber for expanding gaseous refrigerant flowing from an evaporator, a suction chamber for drawing the refrigerant expanded in the expansion chamber, and a resonance chamber in which the refrigerant drawn into the suction chamber resonates. The suction pipe is assembled with the body and connects the suction chamber with a cylinder head of the compressor. The suction pipe provides a passage that the refrigerant in the suction chamber flows into the cylinder head. The refrigerant flows into the suction chamber after being expanded in the expansion chamber, so the noise caused by the pulsation of pressure is reduced, and the refrigerant resonating in the resonance chamber can reduce the noise of a specific frequency. Further, since the suction muffler has a simple construction having small number of components, the leakage of noise through the gaps between components can be reduced.

6 Claims, 3 Drawing Sheets

SUCTION MUFFLER FOR A COMPRESSOR

BACKGROUND OF THE INVENTION

1. Field of the Invention

The present invention relates to a suction muffler for a compressor, and more particularly, to a suction muffler for a compressor capable of reducing noise more effectively using refrigerant expanding in an expansion chamber and resonating in a resonance chamber.

2. Prior Art

Generally, a compressor used in a refrigerator and an air conditioner is an apparatus for drawing gaseous refrigerant of a low temperature and pressure and compressing it into a high temperature and pressure.

The compressor comprises, as shown in FIG. 1, an airtight casing 1 for closing the inner space thereof, a motor 2 comprised of a stator 2*a*, a rotor 2*b* and a rotational shaft 2*c*, a cylinder block 6 installed under the motor 2, a piston 5 moving forward and backward in a cylinder chamber 6*a* formed by the cylinder block 6, a cylinder head 8 installed in front of the cylinder block 6, a valve assembly 7 installed between the cylinder block 6 and the cylinder head 8, a suction muffler 10 through which the refrigerant from an evaporator (not shown) flows into the cylinder chamber 6*a*, and a crank shaft 3 and connecting rod 4 for converting the rotational power of the motor 2 to the motion of the piston 5.

As the piston 5 is driven by the motor 2, the refrigerant from the evaporator is drawn into the cylinder chamber 6*a* through the suction muffler 10, the cylinder head 8, and the valve assembly 7. The refrigerant drawn into the cylinder chamber 6*a* is compressed by the piston 5, and the compressed refrigerant is discharged toward a condenser (not shown) through the valve assembly 7 and the cylinder head 8.

The detailed construction of the suction muffler 10 is as follows.

FIG. 2 is a sectional view of the suction muffler 10. The reference numeral 11 designates the body of the suction muffler 10. The upper part of the body 11 is covered by a cover 12, and a base 13 is assembled with the lower part of the body 11. A baffle 14 having a communication pipe 14*a* is installed in the body 11. The base 13 has a pair of suction pipes 13*a* facing the communication pipe 14*a* of the baffle 14. The lower ends of the respective suction pipes 13*a* are connected to a suction chamber (not shown) of the cylinder head 8. A suction tube 9*a* connected with the evaporator is installed on the upper part of the body 11.

The refrigerant from the evaporator flows into the body 11 through the suction tube 9*a*. The refrigerant flowing into the body 11 is drawn into the suction chamber of the cylinder head 8 through the communication pipe 14*a* of the baffle 14 and the suction pipe 13*a* installed in the base 13. The refrigerant drawn into the suction chamber of the cylinder head 8 is drawn into the cylinder chamber 6*a* through a suction port of the valve assembly 7 while the piston 5 is moving toward the bottom dead center. Then, the refrigerant in the cylinder chamber 6*a* is compressed while the piston 5 is moving toward the top dead center, and the compressed refrigerant is discharged toward the condenser (not shown) through a discharge port of the valve assembly and a discharge chamber of the cylinder head 8. In FIG. 2, the reference numeral 9*b* which has not been illustrated is a discharge tube connecting the discharge chamber of the cylinder head 8 to the condenser.

However, in a conventional compressor having the above-described construction, the suction muffler 10 has the construction that the refrigerant flowing into the body 11 through the suction tube 9*a* is directly drawn into the cylinder chamber 6*a* through the suction pipes 13*a*, which is aimed to reduce the volume thereof. Accordingly, the suction load while the refrigerant is being drawn is great, so great noise may be generated by the pulsation of pressure.

Moreover, since the conventional suction muffler is comprised of many components, noise may leak through gaps between components.

SUMMARY OF THE INVENTION

The present invention has been proposed to overcome the above described problems in the prior art, and accordingly it is an object of the present invention to provide a suction muffler for a compressor, which is capable of reducing noise caused by the pulsation of pressure while refrigerant is being drawn.

Another object of the present invention is to provide a suction muffler for a compressor, which is comprised of a small number of components and less likely to leak noise through gaps between components.

To achieve the above objects, the present invention provides a suction muffler for a compressor, comprising: a body having an expansion chamber for expanding gaseous refrigerant flowing from an evaporator, a suction chamber for drawing the refrigerant expanded in the expansion chamber, and a resonance chamber in which the refrigerant drawn into the suction chamber resonates; and a suction pipe being assembled with the body and connecting the suction chamber and a cylinder head of the compressor to each other, the suction pipe for providing a passage that the refrigerant in the suction chamber flows into the cylinder head.

The expansion chamber, the suction chamber and the resonance chamber are formed by being partitioned from each other by a pair of baffles installed in the body. Furthermore, the expansion chamber and the resonance chamber respectively communicate with the suction chamber through a pair of communication holes formed on the pair of baffles respectively.

It is preferable that the communication holes and an inlet of the suction pipe are distanced from each other in the suction chamber. Accordingly, the paths from the communication holes to the inlet of the suction pipe is long, and thereby noise is reduced more effectively.

It is more preferable that the expansion chamber and the resonance chamber are disposed oppositely to each other, and a pair of suction pipes are provided.

According to the present invention, the noise of the compressor is effectively reduced by the expansion chamber and the resonance chamber, and the noise of a specific frequency can be reduced effectively by adjusting the size of the resonance chamber. In particular, since the suction muffler has a simple construction having a small of number of components, the leakage of noise through the gaps between components is reduced.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
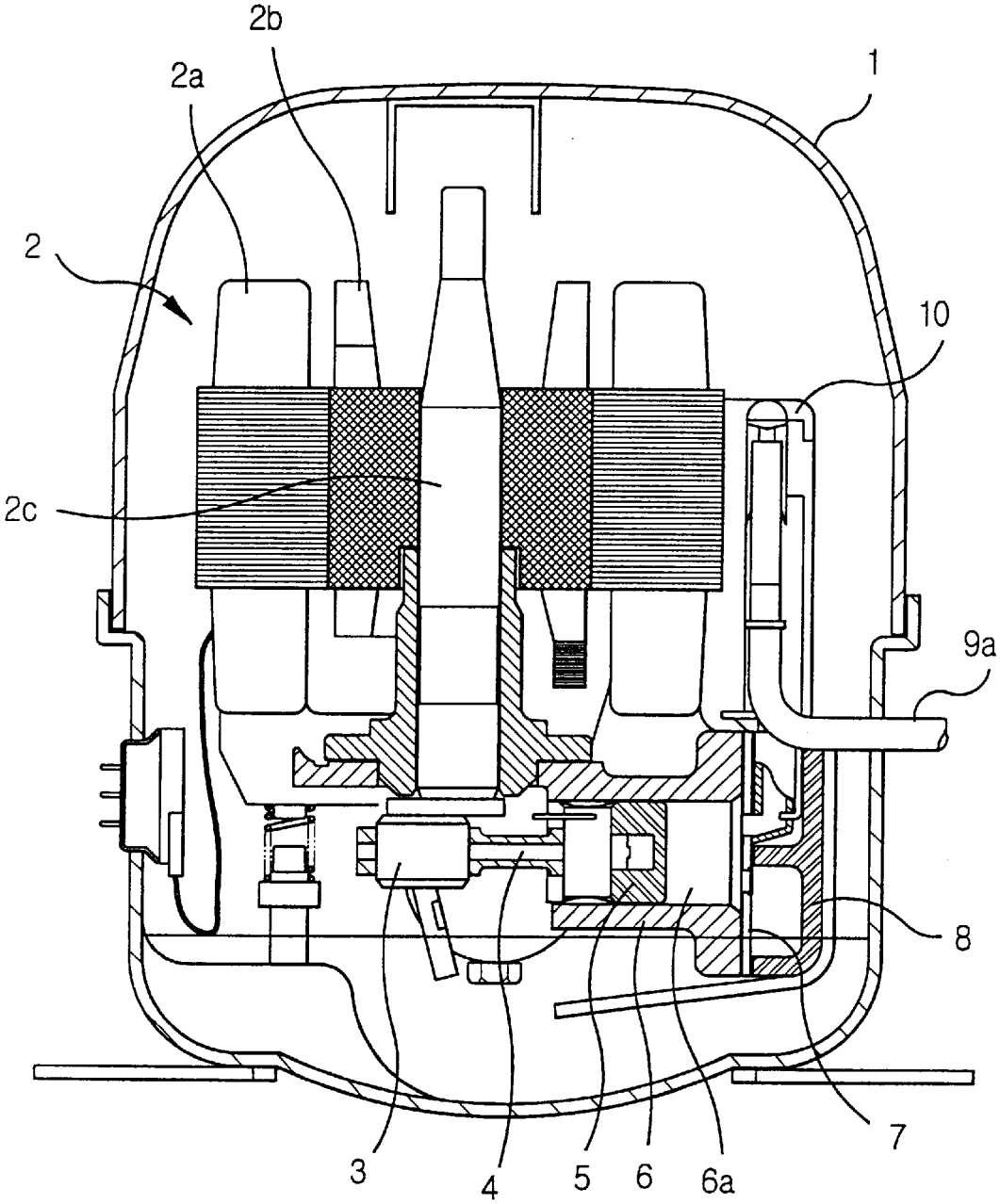
FIG. 1 (PRIOR ART)
FIG. 1 is a sectional view of a general compressor.
Figure 2:
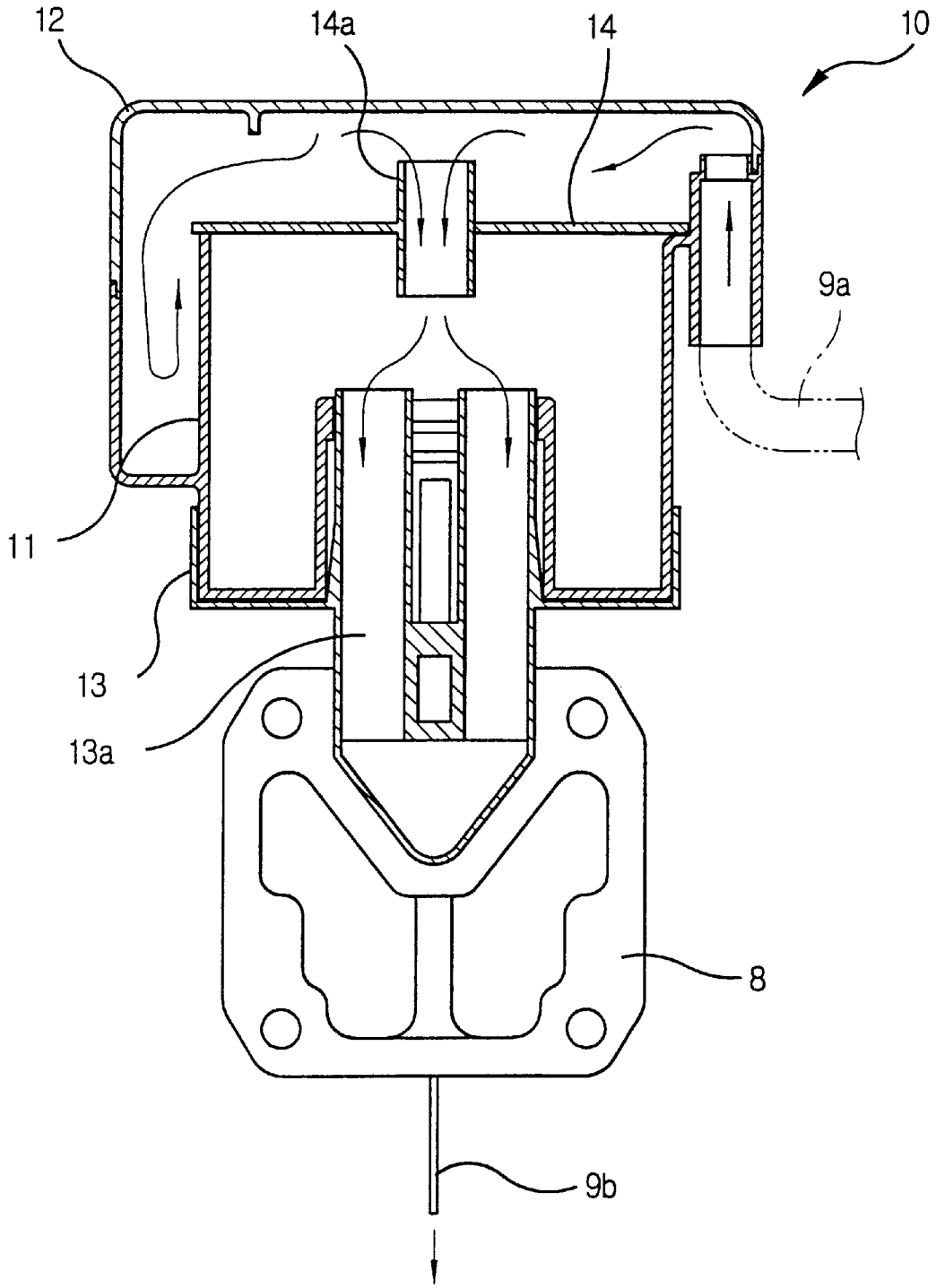
FIG. 2 (PRIOR ART)
FIG. 2 is a sectional view of a suction muffler for the compressor shown in FIG. 1.

Hereinafter, the present invention will be described in detail with reference to the drawings. The respective parts of the general compressor shown in FIG. 1 except for the suction muffler are not described repeatedly, and will be referred to with the same reference numerals.

Figure 3:
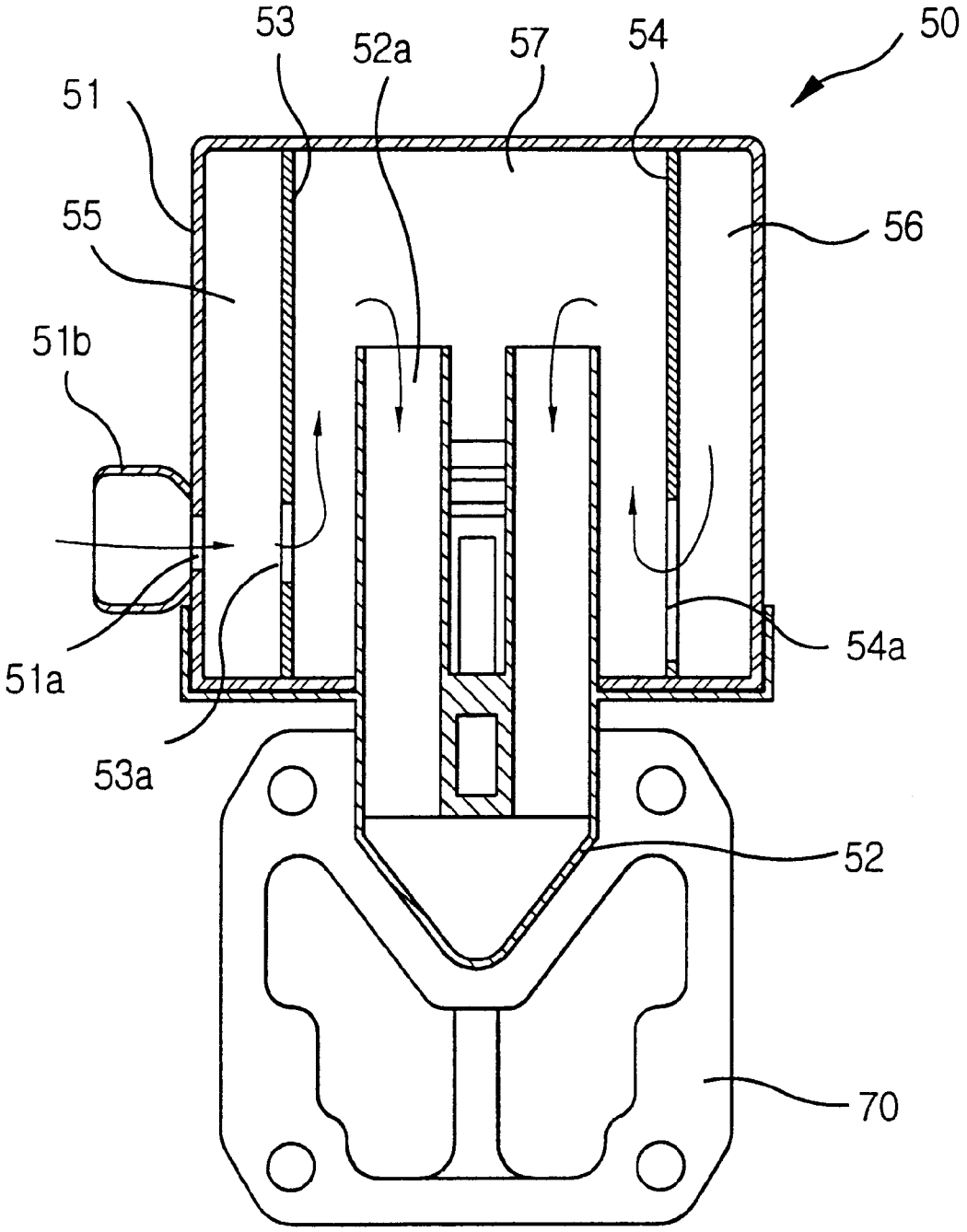
FIG. 3 is a sectional view of a suction muffler for a compressor according to the present invention.

FIG. 3 is a sectional view of a suction muffler of a compressor according to the present invention. As shown in the figure, the suction muffler 50 of the compressor according to the present invention is mainly comprised of a body 51 and a base 52.

In the body 51 are formed three chambers, I. e., an expansion chamber 55, a suction chamber 57, and a resonance chamber 56, partitioned from each other by a first baffle 53 and a second baffle 54. The expansion chamber 55 and the resonance chamber 56 are positioned on both sides of the suction chamber 57, respectively.

The first and the second baffles 53 and 54 respectively have a first communication hole 53*a* and a second communication hole 54*a*. The first and the second communication holes 53*a* and 54*a* are respectively formed at the lower parts of the first and the second baffles 53 and 54. The expansion chamber 55 and the suction chamber 57 communicate with each other through the first communication hole 53*a*, and the suction chamber 57 and the resonance chamber 56 communicate with each other through the second communication hole 54*a*.

A suction port 51*a* is formed at the side of the expansion chamber 55. A guide member 51*b* is attached to the suction port 51*a*. A suction tube (not shown) connected with an evaporator (not shown) is coupled with the guide member 51*b*. Accordingly, the gaseous refrigerant flowing from the evaporator flows into the expansion chamber 55 in the body 51 through the suction tube, the guide member 51*b*, and the suction port 51*a*.

The base 52 is assembled with the lower part of the body 51, and is installed on the cylinder head 70. The base 52 has a pair of suction pipes 52*a* providing passages that the refrigerant drawn into the suction chamber 57 of the body 51 flows toward a suction chamber (not shown) in the cylinder head 70. Preferably, the base 52 is formed together with the suction pipes 52*a*.

The suction pipes 52*a* are disposed in parallel with the first and the second baffles 53 and 54, and are extended upward so that the inlets thereof formed at the upper ends thereof are positioned at the upper area in the suction chamber 57. Since the first and the second communication holes 53*a* and 54*a* are formed at the lower areas of the first and the second baffles 53 and 54, and the suction pipes 52*a* are extended so that the inlets thereof are positioned at the upper area of the suction chamber 57, the communication holes 53*a* and the 54*a* and the inlets of the suction pipes 52*a* are distanced from each other in the suction chamber 57.

Hereinbelow, the process that the refrigerant is drawn by the suction muffler of the compressor according to the present invention having the above-described construction will be described.

The gaseous refrigerant of low temperature and pressure flowing from the evaporator (not shown) flows into the expansion chamber 55 in the body 51 through the suction tube (not shown) coupled with the guide member 51*b* and the suction port 51*a*. The refrigerant flowing into the expansion chamber 55 expands in the expansion chamber 55, and the expanded refrigerant flows into the suction chamber 57 through the first communication hole 53*a* of the first baffle 53. Since the refrigerant expands in the expansion chamber 55, the suction load of the compressor is reduced, and thereby the noise caused by the pulsation of pressure is reduced.

Part of the refrigerant in the suction chamber 57 is sucked into the cylinder head 70 through the suction pipes 52*a*. The refrigerant sucked into the cylinder head 70 finally flows into the cylinder through the valve assembly (not shown). Then, the refrigerant is compressed into a high temperature and pressure refrigerant in the cylinder, and the compressed refrigerant is discharged toward a condenser (not shown) through a discharge tube (not shown).

Meanwhile, the remaining refrigerant in the suction chamber 57 flows into the resonance chamber 56 through the second communication hole 54*a* of the second baffle 54. The refrigerant flowing into the resonance chamber 56 resonates in the resonance chamber 56, and then flows out again into the suction chamber 57 through the second communication hole 54*a*. The noise caused by the reciprocal movement and by the compressing operation of the refrigerant performed by the piston of the compressor flows backward into the suction chamber 57, and the backflow noise is cancelled out by the refrigerant which has resonated in the resonance chamber 56. Accordingly, the noise caused by the pulsation of pressure is reduced.

In such a situation, the noise of a specific frequency can be removed by adjusting the volume and the length of the resonance chamber 56, and the size of the second communication chamber 54*a*. That is, the noise generated during the suction operation of the refrigerant of the compressor is greatest at a specific frequency, and the volume and the length of the resonance chamber 56, and the size of the second communication chamber 54*a* can be adjusted so that the noise of the specific frequency can be cancelled out. Thus, the noise can be effectively reduced. The experimental result shows that a compressor employing the suction muffler according to the present invention can reduce the noise by about 20 dB.

Moreover, since the first communication hole 53*a* and the inlets of the suction pipes 52*a* are distanced from each other in the suction chamber 57, the refrigerant flowing into the suction chamber 57 from the expansion chamber 55 through the first communication chamber 53*a* flows into the suction pipes 52*a* over a long path, so the noise caused by the pulsation of pressure can be effectively reduced. Furthermore, since the second communication hole 54*a* and the inlets of the suction pipes 52*a* are also distanced from each other in the suction chamber 57, the noise flowing back from the compressor can be cancelled out more effectively by the refrigerant flowing out from the resonance chamber 56 toward the suction chamber 57 through the second communication hole 54*a*.

Furthermore, according to the present invention, the suction muffler 50 has a simple construction that is mainly comprised of the body 51 and the base 52. Therefore, the number of components is small, and the leakage of noise through the gaps between components is reduced. Further, manufacturing costs of the suction muffler are reduced.

As described above, according to the present invention, the noise of the compressor is effectively reduced by the expansion chamber and the resonance chamber disposed respectively at both sides of the suction chamber, and the noise of a specific frequency can be reduced effectively by adjusting the size of the resonance chamber. In particular, since the suction muffler has a simple construction having a small of number of components, the leakage of noise through the gaps between the components is reduced.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A suction muffler for a compressor, comprising:

a body having an expansion chamber for expanding gaseous refrigerant flowing from an evaporator, a suction chamber for drawing the refrigerant expanded in said expansion chamber, and a resonance chamber in which the refrigerant drawn into said suction chamber resonates, said expansion chamber and said resonance chamber communicating separately with said suction chamber through respective communication holes; and a suction pipe being assembled with said body and connecting said suction chamber and a cylinder head of said compressor to each other, said suction pipe for providing a passage that the refrigerant in said suction chamber flows into said cylinder head.

2. The suction muffler as claimed in claim 1, wherein said expansion chamber, said suction chamber and said resonance chamber are formed by being partitioned from each other by a pair of baffles installed in said body; and said expansion chamber and said resonance chamber respectively communicate with said suction chamber through a pair of said communication holes formed on said pair of baffles respectively.

3. The suction muffler as claimed in claim 2, wherein said communication holes and an inlet of said suction pipe are distanced from each other in said suction chamber.

4. The suction muffler as claimed in claim 1, wherein said expansion chamber and said resonance chamber are disposed oppositely to each other.

5. The suction muffler as claimed in claim 1, wherein a pair of suction pipes are provided.

6. The suction muffler according to claim 1 wherein there is an absence of direct communication between the expansion chamber and the resonance chamber.

* * * * *